United States Patent [19]

Nilberg

[11] 4,431,341

[45] Feb. 14, 1984

[54] CONSTRUCTION OF A CONCRETE LINED CHAMBER

[75] Inventor: Hans Nilberg, Apple Valley, Calif.

[73] Assignee: Santa Fe International Corporation, Calif.

[21] Appl. No.: 372,302

[22] Filed: Apr. 27, 1982

[51] Int. Cl.[3] ..... E21D 1/00

[52] U.S. Cl. ..... 405/133; 405/55; 405/238

[58] Field of Search ..... 166/285; 405/52–58, 405/132, 133, 238

[56] References Cited

U.S. PATENT DOCUMENTS

| | | | |
|---|---|---|---|
| 2,373,276 | 4/1945 | Thornley | 405/238 |
| 3,191,390 | 12/1960 | Schutte | 405/238 |
| 3,307,361 | 3/1967 | Waterman | 405/133 |
| 3,559,409 | 6/1969 | Johnson | 405/57 |

*Primary Examiner*—Dennis L. Taylor
*Assistant Examiner*—John A. Gungor
*Attorney, Agent, or Firm*—LeBlanc, Nolan, Shur & Nies

[57] ABSTRACT

A procedure for constructing a concrete lined underground chamber along a bore hole drilled within the earth. Such chambers serve as access work chambers for carrying out other various drilling and mining operations, such as, for example, horizontal drilling operations for steam enhanced recovery of oil. In constructing the lined chamber, the bore hole is initially drilled in the earth to a predetermined depth at which the chamber is to be constructed. In a first belling operation, a first bell-shaped chamber is formed. A substantial portion of the floor of this first chamber is then covered with a mound of gravel material. The remainder of the first chamber is then filled with concrete. Subsequently the bore hole is redrilled to a depth extending below the bottom of the first chamber and a second belling operation is carried out for forming a second bell-shaped chamber. The second bell-shaped chamber is spaced below the location of the first bell-shaped chamber but partially overlaps with the first bell-shaped chamber. During the second belling operation, the concrete and gravel within the first chamber is removed except for the concrete in the space between the side walls of the first chamber and the second chamber so that a resulting concrete lined bell-shaped chamber is formed.

30 Claims, 4 Drawing Figures

CONSTRUCTION OF A CONCRETE LINED CHAMBER

BACKGROUND OF THE INVENTION

The present invention relates to the construction of an underground chamber positioned along a deep bore hole within the earth. Such chambers are often used as access work chambers at the bottom of drilled holes particularly when operating in a surrounding environment in the earth of tar sands and oil sands where there is a tremendous tendency for the earth to cave in due to a relatively large implosion pressure.

Such underground chambers for many years have been constructed by sinking a casing within the hole that is formed and then lowering workmen into the casing for cutting through such casing and carving out a chamber within the ground. The workmen then line the chamber with a material, such as a concrete material, for strengthening the chamber and making it waterproof. Such a procedure is both extremely expensive due to the extensive manual labor required as well as being extremely dangerous due to the inherent dangers of working underground, especially in an unlined and relatively unsupported chamber.

Several other techniques have been attempted for constructing underground lined chambers for various purposes. Three such techniques are disclosed in the following U.S. Pat. Nos. 3,191,309 to Schutte; 3,365,894 to Murati; and, 3,559,409 to Johnson.

The patent to Schutte discloses a procedure for use in constructing foundation members below the earth's surface, in particular where the subsurface is such that it is difficult or impossible to maintain a bore wall when drilling a bore hole for the foundation member being constructed. In the procedure set forth by such patent, the bore hole is first drilled in the surface, with the bore hole being filled with mud or other liquid during the drilling operation. Concrete is then mixed with such mud or liquid after the drilling of the hole and then a new hole is drilled in the concrete and mud mixture once the mixture has sufficiently hardened. The new hole is smaller in diameter than the original drilled bore hole so that a retaining wall of the hardened mixture of concrete and mud remains in the hole in order to prevent collapsing of the wall of the hole at least for a sufficient period of time until the foundation material itself can be poured into the hole. Once the bore hole with a bell-shaped bottom portion lined with the concrete and mud mixture is formed, the hole is then filled with the concrete for forming the foundation member.

The patent to Murati discloses a procedure for constructing caissons in a non-cohesive water-permeated ground subsurface environment. In accordance with the construction procedure set forth by such patent a bore hole is initially drilled within the earth. A water tight liner then is forced into the bore hole for supporting the walls of the hole. Next a laterally enlarged bell-shaped cavity is reamed out below the liner. The cavity is subsequently sealed off. A freezant is fed under pressure through the seal into the cavity. This freezant serves a dual purpose of forcing evacuation of any fluid in the cavity upwardly through a conduit passing through the seal and also freezes the walls of the cavity. The cavity and the bore hole are then filled with a water impermeable material such as concrete.

The patent to Johnson discloses a procedure for the construction of an underreamed and integrally grouted underground cavity. In accordance with such construction procedure, a bore hole is first drilled in the earth and a casing is located within such hole. The space between the casing and the bore hole is filled with a grout material and subsequently a larger bore hole cavity is formed in an underreaming procedure beneath the grout. This larger underreamed bore hole is then filled with additional grout material. Finally a small bore hole is drilled from the casing through the additional grout material and in a subsequent underreaming process another bore hole is formed so as to leave a cavity lined with a wall of grout material.

The following U.S. patents each show various techniques for lining bore holes or producing caissons in a drilled hole: U.S. Pat. Nos. 3,100,381 to Case et al.; 3,295,327 to Waterman; and, 3,293,865 to Loofbourow et al. U.S. Pat. No. 2,708,973 illustrates a procedure for bridging fissures or cavities encountered during the drilling of wells utilizing a cement material for sealing off such fissures or cavities. U.S. Pat. No. 3,874,733 to Poundstone et al. discloses one particular type of system for forming an underground belled shaped cavity.

Various techniques and equipment for drilling a bore hole shaft are disclosed in commonly assigned U.S. patent application Ser. Nos. 134,296, filed Mar. 26, 1980 and entitled Bore Hole Mining, and 303,511, filed Sept. 18, 1981 and entitled Blind Shaft Drilling. Various procedures for lining the bore hole shaft itself with concrete liners are disclosed in commonly assigned U.S. patent application Ser. Nos. 165,384, filed July 3, 1980 and entitled Mine Shaft Liner, and 285,815, filed July 22, 1981 and entitled Concrete Lining of Drilled Shaft.

SUMMARY OF THE INVENTION

An object of the present invention is to provide an improved procedure for constructing a concrete lined underground chamber capable of resisting any tendency for ground cave-in due to the implosion pressure in the earth outside of the constructed chamber.

Another object of the present invention is to provide an improved procedure for efficiently and safely constructing a concrete lined underground bell-shaped chamber without any necessity for workmen to enter such chamber until the lining operation is complete.

A further object of the present invention is to provide a construction procedure for forming a lined underground bell-shaped chamber by sequentially drilling two partially overlapping but commonly aligned bell-shaped chambers with the first chamber being filled with a concrete material before performing the second belling operation so that a resulting concrete lined bell-shaped chamber is formed.

These objectives of the present invention are accomplished in accordance with the construction procedure of the present invention. In accordance with such procedure a bore hole is first drilled in the earth to a predetermined depth at which the bell-shaped chamber is to be constructed. A first belling operation is performed for forming a first bell-shaped chamber at a location along the drilled hole. A substantial portion of the floor of this first bell-shaped chamber is covered with a mound of gravel material. The remainder of the first bell-shaped chamber is then filled with concrete. The bore hole is then redrilled through the concrete and gravel in the first bell-shaped chamber with the redrilled hole extending below the bottom of the first bell-shaped chamber. A second belling operation is performed at a distance spaced below the location where the first belling operation was performed so that a second bell-shaped chamber which partially overlaps but is aligned with the first bell-shaped chamber is formed. During the second belling operation the concrete and gravel within the first bell-shaped chamber is removed except for the concrete in the space between the side walls of the first bell-shaped chamber and the second bell-shaped chamber so that a resulting concrete lined bell-shaped chamber is formed.

When forming the mound of gravel material the mound is spaced by a predetermined distance from the side walls of the first bell-shaped chamber. The particular distance of such spacing is at least as large as the desired thickness of the concrete lining that is to be formed in the resulting bell-shaped chamber.

The thickness of the concrete lining in the resulting bell-shaped chamber should be sufficient to prevent buckling of the lining and to resist any tendency for ground cave-in due to the implosion pressure in the earth outside of the resulting bell-shaped chamber. For such purposes, the thickness of the concrete lining is determined based on the anticipated implosion pressure that the walls must withstand in accordance with the following equation:

$$Pim = \frac{2E}{1-\nu^2}(t/D)^3$$

where:
the material integrity is analyzed at the top and bottom of the frustum of the cone by the equation:

$$P = \frac{(f'c)t}{D/2}$$

the stress along the wall of the chamber is $$\sigma_x = \frac{PR}{2h_i\cos d_i}$$

the circumferential stress is $$\sigma_\phi = \frac{PR}{h_i\cos d_i}\left(1-\frac{\nu}{2}\right) + \nu\sigma_x$$

where:
- P=Hydrostatic or ground pressure
- $t/h_i$=Thickness of the lining
- f'c=Concrete compressive strength
- R=Radial distance from axis of symmetry (to wall centerline)
- E=Youngs Modulus
- $\nu$=Poissons Ratio
- D=Diameter at the wall centerline
- $\sigma_x$=Stress along wall
- $\sigma_\phi$=Circumferential stress
- $d_i$=Angle between axis of cone and generator In order to provide a sufficient margin of safety, the thickness of the concrete lining in the resulting bell-shaped chamber should be large enough so as to provide a safety factor of at least 2. With such a safety factor the walls then can withstand at least twice the anticipated implosion pressure.

The first and second bell-shaped chambers that are formed should both be of substantially the same size and shape so that the thickness of the concrete lining of the resulting bell-shaped chamber is substantially uniform. Each of the side walls of the resulting bell-shaped chamber is oriented at a maximum angle of approximately 30° with respect to the vertical. When forming the mound of gravel during the construction procedure the angle of repose of the mound formed on the floor of the first bell-shaped chamber is approximately 37°.

The construction procedure of the present invention can ideally be utilized in forming a lined bell-shaped chamber in an earth formation readily subjected to cave-ins such as in tar sands and oil sands. In constructing such a chamber typically for maximum safety, the thickness of the concrete lining of the resulting bell-shaped chamber is approximately two feet. In order to provide for such a lining, the second belling operation is carried out at a distance of approximately four feet below but coaxially aligned with the location of the first belling operation.

DESCRIPTION OF THE PREFERRED EMBODIMENTS

Figure 4:
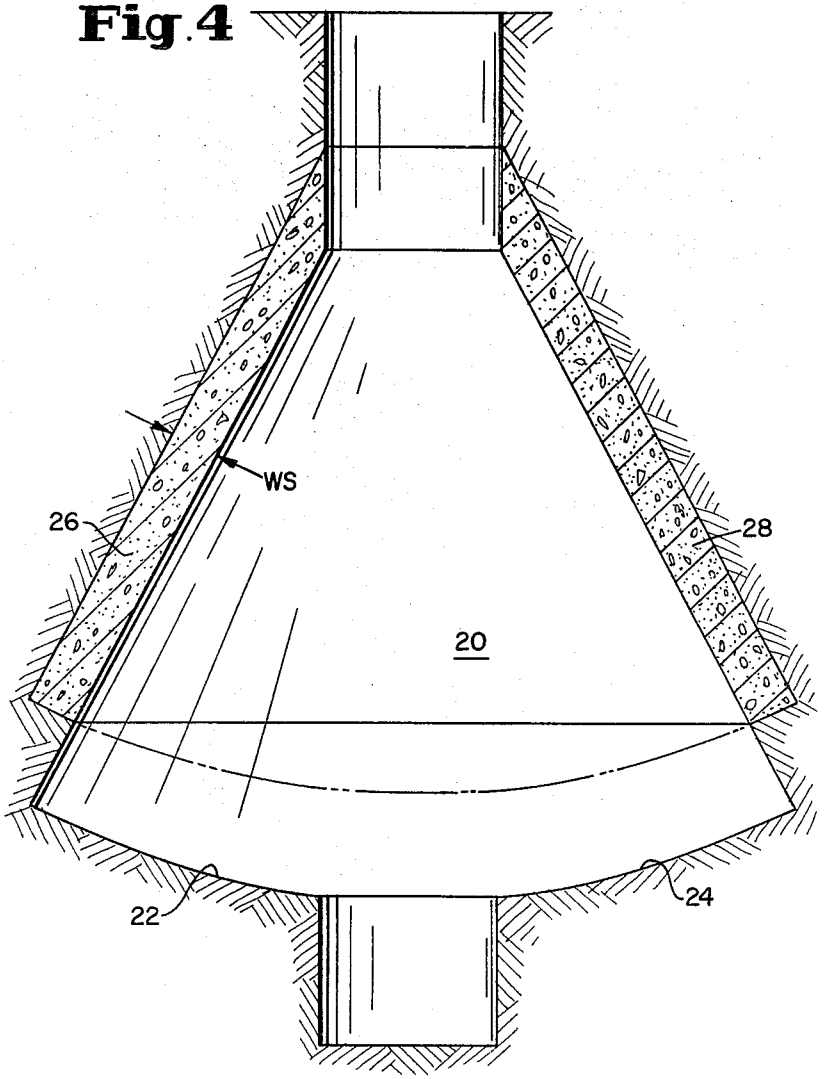
FIG. 4 is a diagrammatic cross-sectional view of the concrete lined resulting bell-shaped chamber after a second belling operation has been performed in accordance with the present invention.

The concrete lined bell-shaped chamber shown in FIG. 4 is constructed in accordance with the process of the present invention. The illustration in FIG. 4 is a cross-section through the bell-shaped chamber. Chamber 20, as shown in such figure, is completely lined with an inner concrete wall such as represented by the cross-sectionally illustrated side walls 26 and 28.

Figure 1:
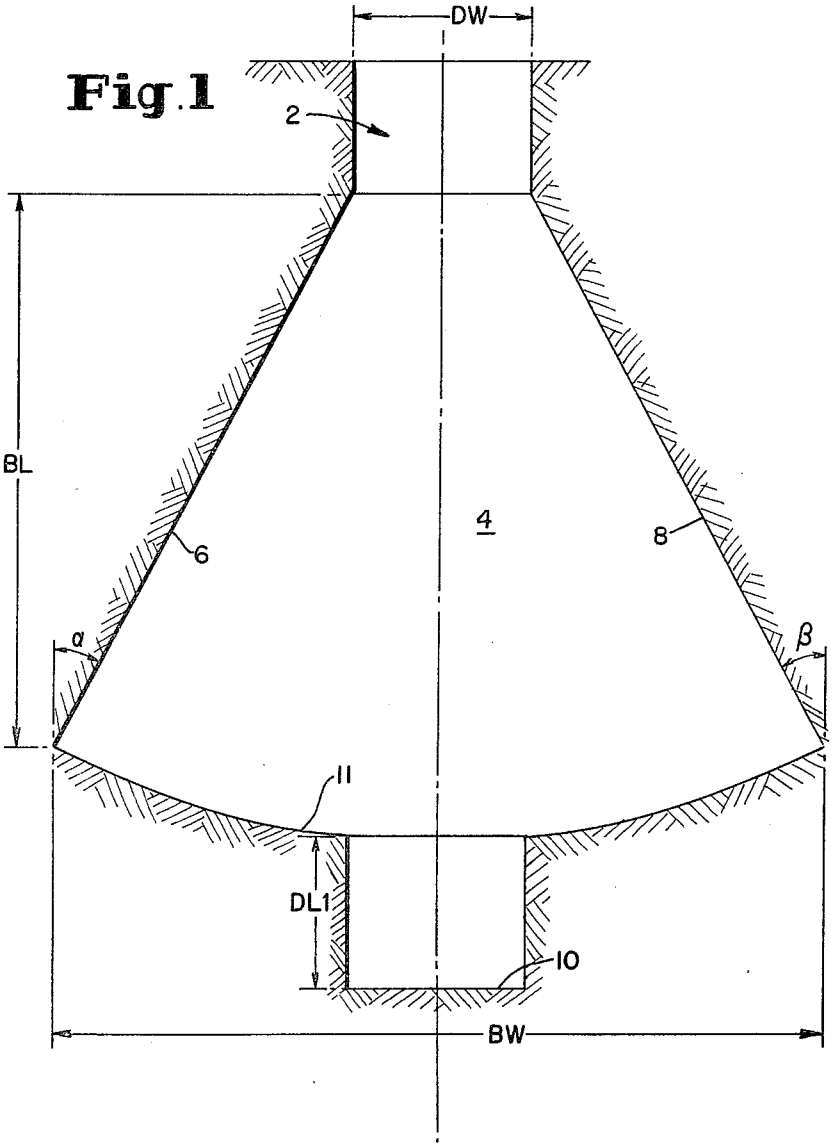
FIG. 1 is a diagrammatic view of the first bell-shaped chamber formed in accordance with an initial step of the procedure of the present invention.

In constructing the concrete lined bell-shaped chamber such as shown in FIG. 4, first a hole 2 is drilled within the earth to a desired depth 10 such as shown in the cross-section in FIG. 1. After the initial hole is drilled, any type of conventional belling tool can be inserted for forming a first bell-shaped chamber 4. This first chamber has an inner wall such as represented by the cross-sectional side walls 6 and 8. The belling tool then is removed and the initial procedures for forming the concrete lining are carried out.

Figure 2:
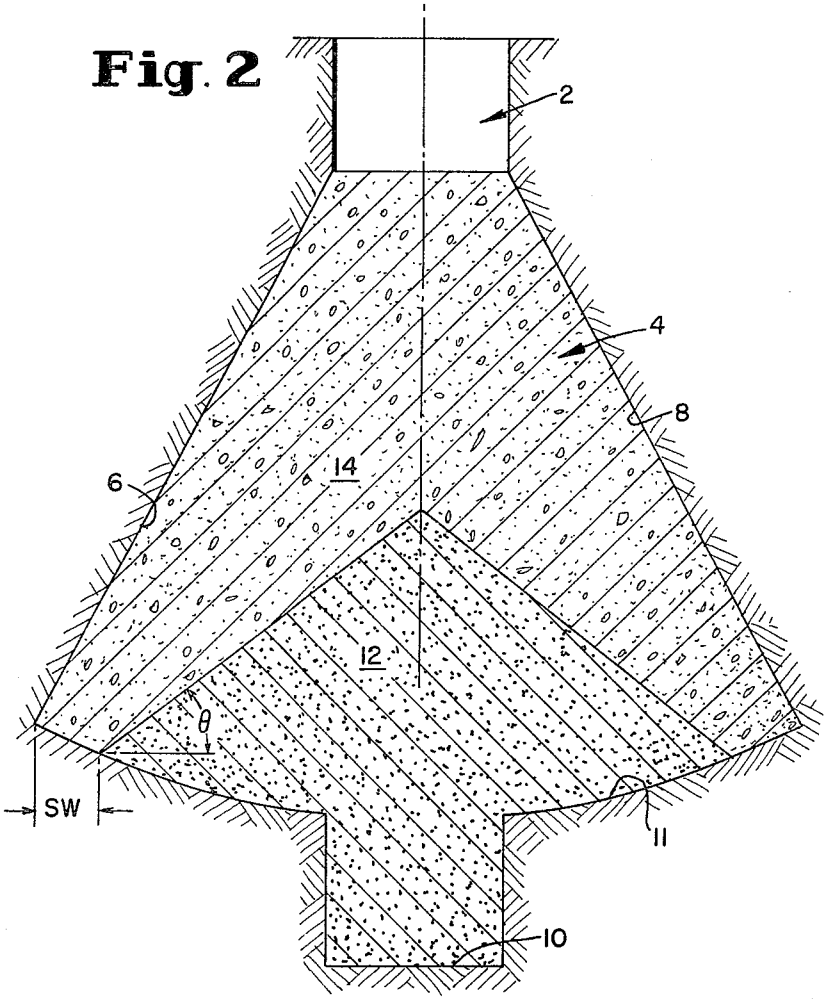
FIG. 2 is a diagrammatic cross-sectional view of the the first bell-shaped chamber filled with a mound of river gravel material and concrete in accordance with a second step of the procedure of the present invention.

River gravel is poured into bell-shaped chamber 4 so as to form a mound on bottom floor portions 10 and 11 of chamber 4. This river gravel forms a mound 12 such as illustrated in FIG. 2. A mixture of high strength concrete, e.g. 5000 psi concrete, is poured into chamber 4 on top of mound 12 of the river gravel so as to fill the rest of the chamber with such concrete such as represented by concrete 14 as illustrated in FIG. 2. Once this concrete hardens the next step in the construction operation occurs.

Figure 3:
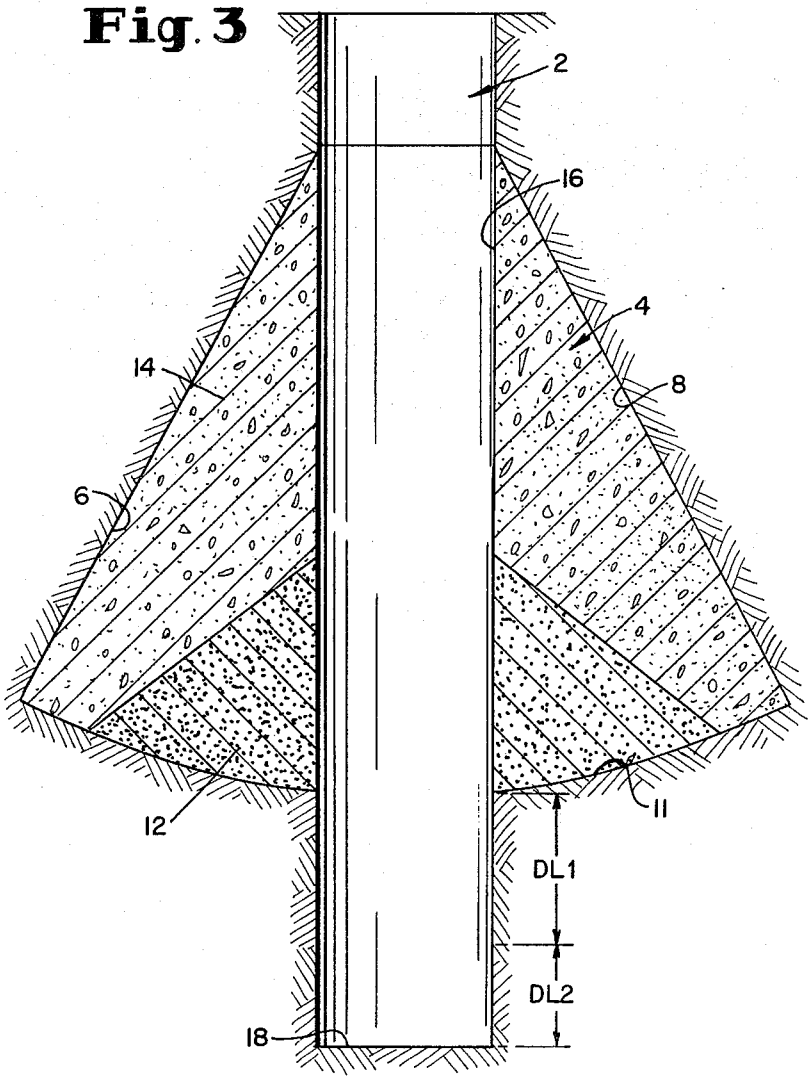
FIG. 3 is a diagrammatic cross-sectional view of the first bell-shaped chamber with the river gravel and concrete such as shown in FIG. 2, with the bore hole being redrilled to a depth extending below the first chamber.

The shaft now is redrilled such as shown by shaft 16 as illustrated in FIG. 3. Shaft 16, however, is drilled to a depth 18 that extends below the prior drilled depth 10, which was shown in FIG. 1. The redrilling of the shaft enables the belling tool now to be reinserted into the drilled shaft for carrying out a second belling operation. The size and shape of the second belling operation should be identical with that of the first belling operation and hence the same belling tool can be used for this purpose. The second belling operation, however, occurs at a depth spaced below that of the first belling operation since the drilled shaft has been drilled to a lower depth within the earth, as shown in FIG. 3.

The second belling operation forms a second bell-shaped chamber 20 with bottom floor portions 22 and 24, as illustrated in FIG. 4. The formation of this second bell-shaped chamber leaves an inner wall of concrete, i.e. a concrete lining, such as represented by the cross-sectional side walls 26 and 28.

Returning to FIG. 1, in the particular embodiment illustrated in these drawings, the length, or height, BL of bell-shaped chamber 4 is 22 feet. The diameter BW of the bell-shaped chamber at its widest point along the bottom of the chamber is 30 feet. The outer wall of the bell-shaped chamber forms an angle of approximately 30° with the vertical. Thus in the illustration of FIG. 1, the cross-sectional side walls 6 and 8 form angles $\alpha$ and $\beta$, respectively with the vertical with $\alpha$ and $\beta$ both being approximately 30°. The depth DL1 to which the drilled shaft hole extends below floor 11 of the bell-shaped chamber is approximately 6 feet and the width DW of the drilled shaft hole is approximately 7 feet.

When the river gravel is poured into chamber 4 so as to form mound 12, the gravel is spaced from the side walls of chamber 4 by a distance SW, which is at least as wide as the width of the concrete lining to be formed within the bell-shaped chamber. The river gravel, as indicated, forms a mound with the side walls of such mound having an angle of repose $\theta$ of approximately 37°. Once the chamber is filled with a mound of river gravel and the poured concrete, which solidifies, the shaft is redrilled to a depth DL2 of approximately 4 feet below the initial depth of such shaft. After carrying out the second belling operation, as shown in FIG. 4, a concrete lining having a thickness WS of approximately 2 feet is formed. The thickness of the concrete lining being formed is dependent upon the anticipated implosion pressure that the concrete lining must withstand. By making the thickness of the lining large enough to withstand the anticipated implosion pressure buckling of the liner is avoided. Such implosion pressure is calculated in accordance with the following equation:

$$Pim = \frac{2E}{1-\nu^2}(t/D)^3$$

where:

the material integrity is analyzed at the top and bottom of the frustum of the cone by the equation:

$$P = \frac{(f^1c)t}{D/2}$$

the stress along the wall of the chamber is $$\sigma_x = \frac{PR}{2\,h_i \cos d_i}$$

the circumferential stress is $$\sigma_\phi = \frac{PR}{h_i \cos d_i}\left(1 - \frac{\nu}{2}\right) + \nu\sigma_x$$

where:

P=Hydrostatic or ground pressure $t_i h_i$=Thickness of the lining $f^1c$=Concrete compressive strength R=Radial distance from axis of symmetry (to wall centerline)

E=Youngs Modulus $\nu$=Poissons Ratio

D=Diameter at the wall centerline $\sigma_x$=Stress along wall $\sigma_\phi$=Circumferential stress $d_i$=Angle between axis of cone and generator Typically a safety margin of at least 2 is provided, which means that the thickness of the walls is at least twice the minimum thickness calculated in accordance with the anticipated implosion pressure.

The present invention may be embodied in other specific forms without departing from the spirit or essential characteristics thereof. The present embodiment is presented merely as illustrative and not restrictive, with the scope of the invention being indicated by the attached claims rather than the foregoing description. All changes which come within the meaning and range of equivalency of the claims are therefore intended to be embraced therein.

What is claimed is:

1. Method of forming a lined underground chamber comprising the steps of:

(a) drilling a bore hole in the earth to a predetermined depth;

(b) performing a first belling operation for forming a first bell-shaped chamber at a location along the drilled hole;

(c) covering a substantial portion of the floor of the first bell-shaped chamber with a gravel material with such gravel material forming a mound;

(d) filling the remainder of the first bell-shaped chamber with concrete;

(e) redrilling the bore hole through the concrete and the gravel in the first bell-shaped chamber with such redrilled hole extending below the bottom of the first bell-shaped chamber;

(f) performing a second belling operation at a distance spaced below the location where the first belling operation was performed so that a second bell-shaped chamber partially overlapping with the first bell-shaped chamber is formed; and (g) during the second belling operation removing the concrete and gravel within the first bell-shaped chamber except for the concrete in the space between the side walls of the first bell-shaped chamber and the second bell-shaped chamber so that a resulting concrete lined bell-shaped chamber is formed.

2. A method according to claim 1 wherein when forming the mound of gravel material such mound is spaced by a predetermined distance from the side walls of the first bell-shaped chamber, such distance being at least as large as the desired thickness of the lining to be formed in the resulting bell-shaped chamber.

3. A method according to claim 1 wherein the first and second bell-shaped chambers have substantially the same size and shape.

4. A method according to claim 1 wherein the second belling operation is carried out so that the thickness of the remaining concrete lining of the resulting bell-shaped chamber is sufficient to withstand the implosion pressure on the concrete lining from the surrounding environment in the earth with the thickness being determined, based on the implosion pressure that the walls must withstand, in accordance with the following equation:

$$Pim = \frac{2E}{1-\nu^2}(t/D)^3$$

where:

the material integrity is analyzed at the top and bottom of the frustum of the cone by the equation:

$$P = \frac{(f^1c)t}{D/2}$$

the stress along the wall of the chamber is $$\sigma_x = \frac{PR}{2\,h_i\cos d_i}$$

the circumferential stress is $$\sigma_\phi = \frac{PR}{h_i\cos d_i}\left(1-\frac{\nu}{2}\right) + \nu\sigma_x$$

where:

P=Hydrostatic or ground pressure $t_ih_i$=Thickness of the lining $f^1c$=Concrete compressive strength R=Radial distance from axis of symmetry (to wall centerline)

E=Youngs Modulus $\nu$=Poissons Ratio

D=Diameter at the wall centerline $\sigma_x$=Stress along wall $\sigma_\phi$=Circumferential stress $d_i$=Angle between axis of cone and generator.

5. A method according to claim 1 wherein the thickness of the concrete lining in the resulting bell-shaped chamber is sufficient to resist any tendency for ground cave-in due to the implosion pressure in the earth outside of the resulting bell-shaped chamber.

6. A method according to claim 4 or 5 wherein the thickness of the concrete lining in the resulting bell-shaped chamber should be sufficient to provide a safety factor of at least 2 so that the walls can withstand at least twice the anticipated implosion pressure.

7. A method according to claim 1, 3, 4 or 5 wherein each of the side walls of the resulting bell-shaped chamber is oriented at a maximum angle of approximately 30° with respect to the vertical.

8. A method according to claim 7 wherein the angle of repose of the mound of gravel formed in the first bell-shaped chamber is approximately 37°.

9. A method according to claim 1, 4, 5 or 6 wherein said method is carried out for forming a resulting bell-shaped chamber in an earth formation readily subject to cave-ins such as in tar sands and oil sands.

10. A method according to claim 1, 4 or 5 wherein the thickness of the concrete lining of the resulting bell-shaped chamber is approximately 2 feet.

11. A method according to claim 10 wherein said second belling operation is carried out at a distance approximately 4 feet below but coaxially aligned with the location of the first belling operation.

12. A method according to claim 8 wherein the gravel material used is river gravel.

13. Method of forming a lined underground chamber comprising the steps of:

(a) drilling a bore hole in the earth to a predetermined depth;

(b) forming a first chamber at a location along the drilled hole;

(c) covering a substantial portion of the floor of the first chamber with a gravel material with such gravel material forming a mound;

(d) filling the remainder of the first chamber with concrete;

(e) redrilling the bore hole through the concrete and the gravel in the first chamber;

(f) forming a second chamber partially overlapping with the first chamber;

(g) during the second chamber forming operation removing the concrete and gravel from the first chamber except for the concrete in the space between the side walls of the first chamber and the second chamber so that a resulting concrete lined chamber is formed; and, (h) the second chamber forming operation being carried out so that the thickness of the remaining concrete lining of the resulting chamber is sufficient to withstand the implosion pressure on the concrete lining from the surrounding environment in the earth with the thickness being determined, based on the implosion pressure that the walls must withstand, in accordance with the following equation:

$$Pim = \frac{2E}{1-\nu^2}(t/D)^3$$

where:

the material integrity is analyzed at the top and bottom of the frustum of the cone by the equation:

$$P = \frac{(f^1c)t}{D/2}$$

the stress along the wall of the chamber is $$\sigma_x = \frac{PR}{2\,h_i\cos d_i}$$

the circumferential stress is $$\sigma_\phi = \frac{PR}{h_i\cos d_i}\left(1-\frac{\nu}{2}\right) + \nu\sigma_x$$

where:

P=Hydrostatic or ground pressure $t_ih_i$=Thickness of the lining $f^1c$=Concrete compressive strength R=Radial distance from axis of symmetry (to wall centerline)
E=Youngs Modulus
$\nu$=Poissons Ratio
D=Diameter at the wall centerline
$\sigma_x$=Stress along wall
$\sigma_\phi$=Circumferential stress
$d_i$=Angle between axis of cone and generator.

14. A method according to claim 13 wherein when forming the mound of gravel material such mound is spaced by a predetermined distance from the side walls of the first chamber, such distance being at least as large as the desired thickness of the lining to be formed in the resulting chamber.

15. A method according to claim 13 or 14 wherein the first and second chambers have substantially the same shape.

16. A method according to claim 14 wherein the thickness of the concrete lining in the resulting bell-shaped chamber should be sufficient to provide a safety factor of at least 2 so that the walls can withstand at least twice the anticipated implosion pressure.

17. A method according to claim 13 wherein the first and second chambers as well as the resulting chamber are all bell-shaped chambers and each of the side walls of the resulting bell-shaped chamber is oriented at a maximum angle of approximately 30° with respect to the vertical.

18. A method according to claim 17 wherein the angle of repose of the mound of gravel formed in the first bell-shaped chamber is approximately 37°.

19. A method according to claim 13 or 16 wherein said method is carried out for forming a resulting chamber in an earth formation readily subject to cave-ins such as in tar sands and oil sands.

20. A method according to claim 17 or 18 wherein the thickness of the concrete lining of the resulting bell-shaped chamber is approximately 2 feet.

21. A method according to claim 17 or 18 wherein said second operation for forming the second bell-shaped chamber is carried out at a distance approximately 4 feet below but coaxially aligned with the location of the first chamber forming operation.

22. A method according to claim 18 wherein the gravel material used is river gravel.

23. Method of forming a concrete lined underground bell-shaped chamber comprising the steps of:

(a) drilling a bore hole in the earth to a predetermined depth;
(b) forming a first chamber at a location along the drilled hole;
(c) covering a substantial portion of the floor of the first chamber with a gravel material with such gravel material forming a mound;
(d) filling the first chamber with concrete;
(e) redrilling the bore hole through the concrete and the gravel in the first chamber with such redrilled hole extending below the bottom of the first chamber;
(f) forming a second chamber at a distance spaced below the location of the first chamber with such second chamber being a bell-shaped chamber partially overlapping with the first chamber;
(g) during the second chamber forming operation removing the concrete and gravel within the first chamber except for the concrete in the space between the side walls of the first chamber and the second bell-shaped chamber so that a resulting concrete lined bell-shaped chamber is formed; and,
(h) the thickness of the concrete lining in the resulting bell-shaped chamber being sufficient to resist any tendency for ground cave-in due to the implosion pressure in the earth outside of the resulting bell-shaped chamber.

24. A method according to claim 23 wherein when forming the mound of gravel material such mound is spaced by a predetermined distance from the side walls of the first chamber, such distance being at least as large as the desired thickness of the lining to be formed in the resulting bell-shaped chamber.

25. A method according to claim 23 wherein the second belling operation is carried out so that the thickness of the remaining concrete lining of the resulting bell-shaped chamber is sufficient to withstand the implosion pressure on the concrete lining from the surrounding enviroment in the earth with the thickness being determined, based on the implosion pressure that the walls must withstand, in accordance with the following equation:

$$Pim = \frac{2E}{1-\nu^2}(t/D)^3$$

where:

the material integrity is analyzed at the top and bottom of the frustum of the cone by the equation:

$$P = \frac{(f^1c)t}{D/2}$$

the stress along the wall of the chamber is $$\sigma_x = \frac{PR}{2\,h_i\cos d_i}$$

the circumferential stress is $$\sigma_\phi = \frac{PR}{h_i\cos d_i}\left(1-\frac{\nu}{2}\right) + \nu\sigma_x$$

where:

P=Hydrostatic or ground pressure
$t_ih_i$=Thickness of the lining
$f^1c$=Concrete compressive strength
R=Radial distance from axis of symmetry (to wall centerline)
E=Youngs Modulus
$\nu$=Poissons Ratio
D=Diameter at the wall centerline
$\sigma_x$=Stress along wall
$\sigma_\phi$=Circumferential stress
$d_i$=Angle between axis of cone and generator.

26. A method according to claim 23 or 25 wherein the thickness of the concrete lining in the resulting bell-shaped chamber should be sufficient to provide a safety factor of a least 2 so that the wall can withstand at least twice the anticipated implosion pressure.

27. A method according to claim 23 wherein each of the side walls of the resulting bell-shaped chamber is oriented at a maximum angle of approximately 30° with respect to the vertical.

28. A method according to claim 23 wherein the angle of repose of the mound of gravel formed in the first bell-shaped chamber is approximately 37°.

29. A method according to claim 23 wherein said method is carried out for forming a resulting bell-shaped chamber in an earth formation readily subject to cave-ins such as in tar sands and oil sands.

30. A method according to claim 23 wherein the thickness of the concrete lining of the resulting bell-shaped chamber is approximately at least 2 feet.

* * * * *